US010407236B2

(12) United States Patent
Draghetti et al.

(10) Patent No.: US 10,407,236 B2
(45) Date of Patent: Sep. 10, 2019

(54) CONTAINER FOR CONSUMER GOODS WITH SLIDING INNER FRAME

(71) Applicant: PHILIP MORRIS PRODUCTS S.A., Neuchatel (CH)

(72) Inventors: Fiorenzo Draghetti, Medicina (IT); Lucas Chatelain, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/062,672

(22) PCT Filed: Dec. 21, 2016

(86) PCT No.: PCT/EP2016/082120
§ 371 (c)(1),
(2) Date: Jun. 15, 2018

(87) PCT Pub. No.: WO2017/108914
PCT Pub. Date: Jun. 29, 2017

(65) Prior Publication Data

US 2018/0370716 A1 Dec. 27, 2018

(30) Foreign Application Priority Data

Dec. 21, 2015 (EP) ..... 15201762

(51) Int. Cl.
*B65D 85/10* (2006.01)
*B65B 19/22* (2006.01)

(52) U.S. Cl.
CPC ..... *B65D 85/1009* (2013.01); *B65B 19/22* (2013.01); *B65D 85/1045* (2013.01)

(58) Field of Classification Search
USPC ..... 206/249, 250, 254, 255
See application file for complete search history.

(56) References Cited

U.S. PATENT DOCUMENTS 4,240,548 A * 12/1980 Stio ..... B65D 85/1009 206/250
5,435,439 A * 7/1995 Swart ..... B65D 85/1009 206/249

(Continued)

FOREIGN PATENT DOCUMENTS

CN 1075462 8/1993
CN 1038405 1/1994

(Continued)

OTHER PUBLICATIONS

PCT International Search Report and Written Opinion for PCT/EP2016/082120 dated Jan. 30, 2017 (9 pages).

(Continued)

*Primary Examiner* — Jacob K Ackun
(74) *Attorney, Agent, or Firm* — Mueting, Raasch & Gebhardt, P.A.

(57) ABSTRACT

A container (10) for consumer goods, the container comprising: an outer housing comprising a box portion (12), a lid portion (14) moveable between a closed position and an open position, and a hinged connector (16) connecting the box portion (12) and the lid portion (14); a plurality of consumer goods (20) received within the box portion (12); and an inner frame (18) slidably received within the outer housing and positioned between the plurality of consumer goods (20) and the box portion (12). The inner frame (18) is slidable between a lowered position and a raised position and comprises an inner frame front wall (36), an inner frame back wall (38), opposed inner frame side walls and a lifting element (48), depending from the bottom edge of a wall of the inner frame (18) and extending into the opening at the bottom end of the inner frame. At least part of the lifting element (18) is positioned between a box portion bottom wall and the consumer goods. The lid portion (14) depends along a first hinge line (30) from the hinged connector and (Continued)

along a second hinge line (44) from the inner frame (18) so that the inner frame (18) slides between the lowered position and the raised position as the lid portion (14) moves between the closed position and the open position.

15 Claims, 7 Drawing Sheets

(56) References Cited

U.S. PATENT DOCUMENTS

| | | | | |
|---|---|---|---|---|
| 7,147,103 | B2 * | 12/2006 | Retelski | B65D 85/1009 206/250 |
| 2005/0016876 | A1 * | 1/2005 | Ghini | B65D 85/1009 206/261 |
| 2015/0122676 | A1 | 5/2015 | Brugger | |
| 2015/0232261 | A1 * | 8/2015 | Brugger | B65D 85/1009 206/268 |
| 2017/0327304 | A1 * | 11/2017 | Chatelain | B65D 5/6685 |
| 2018/0215530 | A1 * | 8/2018 | Chatelain | B65D 85/1009 |
| 2018/0215531 | A1 * | 8/2018 | Polloni | B65D 85/1009 |

FOREIGN PATENT DOCUMENTS

| | | |
|---|---|---|
| CN | 2689722 | 4/2005 |
| CN | 101535134 | 9/2009 |
| CN | 102730262 | 10/2012 |
| CN | 104053612 | 9/2014 |
| CN | 104271465 | 1/2015 |
| DE | 2113844 | 9/1972 |
| EP | 0928751 | 7/1999 |
| EP | 2754622 | 7/2014 |
| FR | 2087240 | 12/1971 |
| WO | WO 2015/121831 | 8/2015 |
| WO | WO 2015/141010 | 9/2015 |
| WO | WO 2016/207310 | 12/2016 |

OTHER PUBLICATIONS

European Extended Search Report for Application No. 15201762.0 dated Apr. 20, 2016 (8 pages).

Office Action issued in China for Application No. 201680069575.6 dated May 28, 2019 (11 pages). English translation included.

* cited by examiner

CONTAINER FOR CONSUMER GOODS WITH SLIDING INNER FRAME

This application is a U.S. National Stage Application of International Application No. PCT/EP2016/082120, filed Dec. 21, 2016, which was published in English on Jun. 29, 2017, as International Publication No. WO 2017/108914 A1. International Application No. PCT/EP2016/082120 claims priority to European Application No. 15201762.0 filed Dec. 21, 2015.

The present invention relates to a container for consumer goods, the container comprising a sliding inner frame coupled to a pivotable lid. The invention finds particular application as a container for elongate consumer goods, such as smoking articles.

Consumer goods such as smoking articles are commonly packaged in rigid box shaped containers, such as hinge lid containers having a box portion and a lid connected to the box portion about a hinge line extending across the back wall of the container, a so called Flip-Top' box. In some cases, the container further includes an inner frame wrapped around at least a portion of the consumer goods. This may provide further rigidity to the container and protect the consumer goods. Where the inner frame extends above an upper edge of the box portion, the inner frame also provides a surface against which the lid can close.

To minimise the amount of material used to form each container and to make each container a convenient size for a consumer, containers are typically only as large as they need to be to contain the desired number of consumer goods. However, in some cases such tight packaging of the consumer goods within the container can make it difficult to remove the first of the consumer goods from the container. For example, in the case of a plurality of smoking articles packaged in a hinge lid container it can be difficult to grasp the end of a smoking article when the container is full.

WO-A-2015/141010 describes a hinge lid package comprising a receiving section, a hinge lid and a rising and lowering section provided on the lower side of the receiving section, on which the objects within the receiving may be placed, wherein the rising and lowering section rises and lowers in co-ordination with the opening and closing of the hinge lid.

It would be desirable to provide a container for consumer goods that facilitates removal of the first of a plurality of consumer goods from the container. It would be particularly desirable to provide such a container that is substantially the same size and shape as a conventional container of consumer goods and can be produced using existing high speed manufacturing machines and processes with minimal modification.

According to the invention there is provided a container for consumer goods, the container comprising an outer housing comprising: a box portion, a lid portion pivotable between a closed position and an open position in which consumer goods can be removed from the box portion and a hinged connector connecting the box portion and the lid portion; a plurality of consumer goods received within the box portion; and an inner frame slidably received within the outer housing and positioned between the plurality of consumer goods and the box portion. The inner frame is slidable between a lowered position and a raised position. According to the invention, the inner frame comprises a lifting element, at least a part of which is positioned between a box portion bottom wall and the consumer goods such that sliding the inner frame from the lowered position towards the raised position engages the lifting element with a selection of the plurality of consumer goods and lifts the selection of consumer goods away from the box portion bottom wall. The lid portion depends along a first hinge line from the hinged connector and along a second hinge line from the inner frame so that the inner frame slides between the lowered position and the raised position as the lid portion pivots between the closed position and the open position.

In the following description of the invention the terms "side", "top", "bottom", "front", "back" and other terms used to describe relative positions of the components of containers according to the invention refer to the container in an upright position with the lid portion at the top. When describing containers according to the present invention, these terms are used irrespective of the orientation of the container being described. In those embodiments in which a lid portion back wall depends from a box portion back wall along a hinge line, the hinge line is located at the back of the container and allows opening of the lid portion by a pivotal movement about the hinge line. The "front" of the container refers to the side of the container opposite the "back" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels. The term "flap" refers to a panel that depends from only one other panel.

The term "wall" refers more generally to a facet of the container, and a wall may be formed from a single panel or flap, or a wall may be formed from two or more abutting or overlapping panels or flaps.

The term "weakening line" is used herein to refer to a line of weakening along which the material in which the weakening line is formed can be folded or broken. For example, a weakening line may comprise at least one of a fold line, a score line, a perforation line, a creasing line and a cut line. In containers according to the present invention, each of the hinges lines is preferably defined by a weakening line.

The terms "depend" and "depending" are used herein to refer to a connection between a wall, panel or flap and an adjacent wall, panel or flap. Walls, panels and flaps may depend along one or more weakening lines from an adjacent wall, panel or flap. A wall, panel or flap may depend along a single weakening line from an adjacent wall panel or flap, wherein the wall, panel or flap is typically folded along the single weakening line at an angle of approximately 90 degrees in a substantially parallelepiped container. Alternatively, a wall, panel or flap may depend along multiple weakening lines from an adjacent wall, panel or flap. For example, multiple parallel and coextensive weakening lines may be formed in a laminar blank so that, when the laminar blank is folded along the multiple weakening lines, a substantially rounded or bevelled edge is formed between the adjacent walls, panels or flaps. Alternatively, multiple overlapping but staggered weakening lines may be formed in a laminar blank so that, when the laminar blank is folded along the multiple weakening lines, a twisted edge is formed between the adjacent walls, panels or flaps.

Alternatively, walls, panels and flaps may depend from adjacent walls, panels and flaps along a weakening strip. For example, material may be removed from a surface of a laminar blank using an ablation tool, such as a laser or a blade. The portion of the blank from which the material is removed forms a weakening strip along which it may be easier to deform the blank when the blank is converted into the container. For example, in those containers that may otherwise comprise multiple weakening lines to form a substantially rounded edge between adjacent walls, panels or flaps, the multiple weakening lines may be replaced with a weakening strip having a width corresponding to the total width between the first and last multiple weakening lines. By eliminating discrete weakening lines a weakening strip can form a true rounded edge, whereas a substantially rounded edge formed by multiple weakening lines may retain discernible weakening lines.

The term "weakening zone" is used herein to encompass weakening lines, including fold lines, score lines, perforation lines and cut lines, and weakening strips, including ablated areas.

The term "selection" is used herein to refer to a subset of a total number. Therefore, a selection of consumer goods within a container may be a single consumer good, or the selection of consumer goods may be a plurality of consumer goods up to and including the total number of consumer goods minus one.

The containers according to the invention provide a slidable inner frame comprising a lifting element configured to engage a selection of the consumer goods, which advantageously provides a convenient means to facilitate the lifting of the selection of consumer goods. Specifically, to facilitate the removal of consumer goods from the container when the container is full, the inner frame can slide away from the box portion bottom wall so that the lifting element lifts the selection of consumer goods relative to the remainder of the plurality of consumer goods, therefore making it easier to grasp one or more of the consumer goods in the selection of consumer goods. For example, in those embodiments in which the consumer goods are a plurality of elongate smoking articles, lifting the selection of consumer goods raises an end portion of each consumer goods within the selection of consumer goods above the end portions of the adjacent remaining consumer goods. In such embodiments, containers according to the present invention therefore make it easier to grasp the end portion of each of the consumer goods within the selection of consumer goods.

The lifting element is incorporated into the inner frame and this facilitates the manufacture of containers according to the present invention using existing high speed manufacturing machines and processes with minimal modification, such machines typically being already configured for the manufacture of containers comprising a box portion, a lid portion and an inner frame.

The inner frame incorporating the lifting element is in the form of a sleeve, comprising an inner frame front wall, an inner frame back wall, opposed inner frame side walls and an opening at the bottom end, into which the lifting element extends. Preferably, the entire bottom end of the inner frame is open, other than the lifting element. The inner frame of the containers according to the invention therefore provides a structure that is similar to a conventional inner frame. The lifting element can be incorporated without significantly impacting the appearance and function of the inner frame. Advantageously, the inner frame incorporating the lifting element can therefore be manufactured and assembled without the need for significant modification of existing laminar blanks, or of the manufacturing and assembly processes and apparatus. However, unlike conventional inner frames, the inner frame of containers according to the invention is not adhered to the box front wall or any other box wall, to allow a liner movement of the inner frame within and partially outside of the box.

In the containers according to the invention, the lid portion depends from the inner frame along the second hinge line. This means that the sliding motion of the inner frame is coupled to the pivotal movement of the lid portion so that movement of the lid portion from the closed position to the open position automatically slides the inner frame upwards into the raised position. The opening of the lid portion will therefore automatically result in the lifting element lifting the selection of consumer goods to facilitate removal of one or more of the selection of consumer goods from the container.

In addition to being connected to the inner frame along the second hinge line, the lid portion is connected to the hinged connector about the first hinge line. The lid portion is therefore pivotable about both the first hinge line and the second hinge line. The hinged connector provides a connection between the lid portion and the box portion. As will be seen from the discussion of the invention below, the arrangement of the hinged connector advantageously enables a greater extent of movement of the lid portion relative to the box portion. This in turn enables a greater extent of sliding movement of the inner frame so that a more significant lifting effect is achieved.

On the other hand, the connection between the lid portion and the box portion also restricts the movement of the lid portion and therefore the inner frame beyond a certain point. This advantageously prevents the inadvertent removal of the inner frame and the consumer goods from the outer housing.

As discussed below, in certain embodiments of the invention, the arrangement of the hinged connector is such that the outer housing can be formed from a laminar blank of a conventional hinge lid container with minimal modification. This enables containers according to the invention to be manufactured using existing high speed machines and processes.

The hinged connector is formed of one or more panels of the outer housing which are positioned in the outer housing between the box portion and the lid portion. Preferably, the first hinge line along which the hinged connector is connected to the lid portion substantially coincides with the back edge of the lid portion top wall. The hinged connector therefore extends partially down the back wall of the outer housing from the top, back edge of the outer housing. The hinged connector may be formed integrally with the lid portion, the box portion, or both the lid portion and the box portion. Alternatively, the hinged connector may be formed separately and adhered to at least one of the lid portion and the box portion.

Preferably, the hinged connector depends along a third hinge line from the box portion. In such embodiments, the hinged connector is therefore provided with two articulation points. This arrangement optimises the translation of the rotational movement of the lid portion into the sliding movement of the inner frame. Furthermore, the addition of the third hinge line facilitates a greater degree of opening of the lid portion and therefore a greater degree of sliding movement of the inner frame.

The first hinge line and the third hinge line preferably extend substantially horizontally across the hinged connector. Preferably, each of the first hinge line and the third hinge line are substantially straight. The third hinge line preferably substantially coincides with the second hinge line when the lid portion is in the closed position.

Preferably, the third hinge line substantially coincides with the top edge of the box portion back wall. This corresponds to the position of the hinge line between the lid portion and the box portion of a conventional hinge lid container. In such embodiments, the position of the hinged connector therefore coincides with the position of the lid portion back wall in a conventional hinge lid container.

Preferably, the hinged connector forms at least a part of the lid portion back wall. However, in alternative embodiments, the hinged connector may form a part of the box portion back wall. In further alternative embodiments, the hinged connector may be provided as a separate component connecting the box portion and the lid portion but not forming an integral part of either the box portion back wall or the lid portion back wall.

In particularly preferred embodiments of the invention, the hinged connector is formed of an intermediate panel of the lid portion back wall, the intermediate panel depending along the first hinge line from the lid portion top wall and along the third hinge line from the box portion. In such embodiments, the intermediate panel forming the hinged connector may be defined by cut lines in the lid portion back wall, the cut lines extending from the first hinge line to the third hinge line. For example, the intermediate panel forming the hinged connector may be defined by a pair of substantially parallel, opposed cut lines extending substantially vertically from the top edge of the lid portion back wall to the third hinge line. These cut lines can be incorporated into the laminar blank prior to assembly of the outer housing so that the assembly process of containers according to the invention can advantageously be carried using conventional apparatus and methods.

Preferably, the width of the hinged connector corresponds to at least 30 percent of the width of the outer housing, more preferably at least 40 percent and most preferably at least 50 percent. This helps to ensure that the hinged connector has sufficient structural integrity to allow for repeated opening and closing of the lid portion. Alternatively or in addition, the width of the hinged connector preferably corresponds to no more than 80 percent of the width of the outer housing, more preferably no more than 70 percent.

The provision of the hinged connector between the lid portion and the box portion of the outer housing enables a greater degree of movement of the lid portion relative to the box portion. Unlike in a conventional hinge lid container in which the lid portion is pivotable about a fixed hinge line, in the containers of the present invention, the first hinge line about which the lid portion pivots is also moveable relative to the box portion. This means that the lid portion is able to not only pivot relative to the box portion but in addition, the hinged connector enables the lid portion to move linearly, together with the first hinge line, away from the box portion. As the lid portion moves from the closed position into the open position, it therefore has both a pivotal movement and a translational movement relative to the box portion. This provides a unique way of opening the container.

As described above, the lid portion of containers according to the present invention is pivotable about both the first hinge line and the second hinge line and the lid portion will pivot about both of these hinges lines during movement of the lid portion between the closed position and the open position. The lid portion preferably has a cup shaped form, with a lid portion front wall, a lid portion top wall, opposed lid portion side walls and a lid portion back wall. The lid portion forms a part of the outer housing but is also connected to the inner frame in such a way as to provide the pivotal movement of the lid portion about the second hinge line, which extends across the inner frame. The lid portion may be integral to the inner frame but more preferably, the lid portion is separate from and affixed to the inner frame. Preferably, the lid portion is formed from the same laminar blank as the box portion, as discussed below.

Preferably, the lid portion comprises a first lid portion back panel depending along the second hinge line from the inner frame back wall and a second lid portion back panel depending along the second hinge line from the inner frame back wall, wherein the hinged connector extends between the first and second lid portion back panels.

Preferably, the first and second lid portion back panels and the hinged connector are formed from the lid portion back wall. For example, in embodiments in which the hinged connector is formed from an intermediate panel defined by two opposed cut lines extending down the lid portion back wall, as described above, the first and second lid portion back panels may be provided by the remaining panels of the lid portion back wall, on either side of the intermediate panel forming the hinged connector. In this arrangement, the first and second lid portion back panels and the intermediate panel forming the hinged connector together define the lid portion back wall.

When the lid portion is in the closed position, the first and second lid portion back panels and the intermediate panel will lie substantially flush in the same plane as each other, providing a substantially flat back wall to the lid portion. In this position, the containers according to the invention will therefore have substantially the same appearance as a conventional hinge lid container. As the lid portion is moved to the open position, the first and second lid portion back panels will move, together with the inner frame, away from the intermediate panel.

Preferably, the first and second lid portion back panels are adhered to the inner frame. Preferably, the inner frame comprises one or more inner frame connector panels depending along the second hinge line from the inner frame back wall, wherein the one or more inner frame connector panels are affixed to the inner surface of the first and second lid portion back panels. This provides the required connection of the lid portion and the inner frame which enables the movement of the inner frame to be coupled to the pivotal motion of the lid portion.

Preferably, the one or more inner frame connector panels are defined by a weakening line extending across the inner frame back wall at a distance from the top edge of the inner frame back wall The inner frame may comprise a single inner frame connector panel that is affixed to both of the first and second lid portion back panels. Alternatively, the inner frame may comprise a pair of inner frame connector panels, wherein each inner frame connector panel is affixed to the respective lid portion back panel.

Preferably, the height of the inner frame connector panels substantially corresponds to the height of the lid portion back wall such that the second hinge line substantially coincides with the bottom edge of the first and second lid portion back panels.

As described above, the inner frame of the containers of the present invention is slidably mounted within the box portion for movement between a lowered position and a raised position. The sliding movement is preferably in a substantially vertical direction such that the inner frame moves upwards from the lowered position towards the raised position. In the lowered position, the inner frame is at its lowest point within the box portion such that the lid portion is able to fully close. As in a conventional hinge lid pack, an upper portion of the inner frame may protrude above the top edges of the box portion in the lowered position. The inner frame front wall may comprise a cut out at the top end to expose a greater length of the consumer goods, such that removal of the consumer goods from the container is facilitated. In the raised position, the inner frame is elevated from the box portion such that a larger proportion of the inner frame walls is visible above the top edges of the box portion.

The inner frame is positioned around the plurality of consumer goods and preferably comprises an inner frame front wall, opposed inner frame side walls and an inner frame back wall. The top end of the inner frame is preferably open to enable removal of the consumer goods. The walls of the inner frame may comprise one or more indicia that remain hidden underneath the corresponding walls of the box portion in the lowered position of the inner frame but become revealed as the inner frame is moved upwards towards the raised position.

The inner frame of containers according to the invention incorporates a lifting element at the bottom end for lifting a selection of the consumer goods away from the remainder of the consumer goods upon first opening of the container. At least a part of the lifting element is positioned between the consumer goods and the box portion bottom wall in order to support and lift the selection of consumer goods. Where the consumer goods are elongate consumer goods, such as smoking articles, the lifting element preferably supports partially or completely the end or ends of the selection of consumer goods to be lifted.

The shape and size of the part of the lifting element underlying the selection of consumer goods can be adapted depending on how many of the consumer goods are intended to be lifted during the first opening. For example, where the container houses a plurality of smoking articles, the lifting element may be adapted to elevate a single smoking article.

The lifting element preferably extends from the bottom edge of the inner frame front wall. In such embodiments, the bottom end of the inner frame is otherwise open to enable the inner frame to be lifted relative to the consumer goods into the raised position. Alternatively, the lifting element could extend from the bottom edge of an inner frame side wall, or the inner frame back wall.

In certain embodiments of the invention, the lifting element is in the form of a two-dimensional lifting tab extending from a bottom edge of one of the inner frame walls. The lifting tab is provided under the selection of consumer goods and is configured to support and lift the selection of consumer goods from beneath as the inner frame is moved into the raised position. Preferably, the lifting tab depends along a first weakening zone from the inner frame front wall or an inner frame side wall. Preferably, the lifting tab is folded about the first weakening zone so that the lifting tab is substantially parallel to the box portion bottom wall.

In other embodiments, the inner frame comprises a three-dimensional lifting element having a bottom lift panel underlying the selection of consumer goods and at least one side lift panel extending upwards from the bottom lift panel on at least one side of the selection of consumer goods. Preferably, the lifting element comprising the bottom and side lift panels depends along one or more weakening zones from the inner frame front wall. Preferably, the lifting panels of the lifting element are folded about the one or more weakening zones so that the bottom lift panel is substantially parallel to the box portion bottom wall and the or each side lift panel is substantially perpendicular to the bottom lift panel. This arrangement provides improved rigidity to the lifting element. Furthermore, the inclusion of the at least one side lift panel may provide additional support to the selection of consumer goods during lifting.

The lifting element is preferably integrally formed with the inner frame from a single laminar blank, for example, through an appropriate arrangement of fold lines and cut lines at the bottom end of the laminar blank.

To accommodate the manufacture of multiple laminar blanks for forming multiple inner frames, the inner frame may comprise a cut-out in the inner frame front wall and extending from a top edge of the inner frame front wall, wherein the cut-out has an area that is equal to or greater than the area of the one or more panels or tabs forming the lifting element. In such embodiments, multiple inner frame blanks can be cut from a roll of material with substantially little or no waste material generated, as the lifting element of each blank can be formed within the cut-out in the consecutive blank. The cut-out in the inner frame front wall extending from the top edge of the inner frame front wall may also further improve access to the selection of consumer goods and facilitate their removal from the container, as described above.

In some embodiments, the container may further comprise an inner wrapper wrapped around the plurality of consumer goods. Preferably, the inner wrapper comprises an aperture in a position corresponding to the lifting element of the inner frame such that the lifting element can contact the selection of consumer goods through the aperture.

The aperture may be substantially the same size as the box portion bottom wall so that none of the inner wrapper is positioned between the plurality of consumer goods and the box portion bottom wall. That is, the inner wrapper may lack an inner wrapper bottom wall.

Alternatively, the inner wrapper may comprise an inner wrapper bottom wall with an aperture having a size and shape that uncovers only the selection of consumer goods to be lifted. In such embodiments, the inner wrapper is preferably affixed to the box portion bottom wall. For example, the inner wrapper bottom wall may be adhered to the inner surface of the box portion bottom wall. This helps to ensure that only the selection of consumer goods are lifted as the inner frame moves upwards, with the remainder of consumer goods remaining within the box portion.

Preferably, the aperture extends upwards from the position of the lifting element, for example up the inner frame front wall, to enable upwards movement of the lifting element.

In alternative embodiments, the inner wrapper may comprise an arrangement of cut lines that enables it to deform locally to allow the necessary movement of the lifting element as the inner frame is moved into the raised position.

Where an inner wrapper is present, the inner wrapper may be formed from metal foil, metallised paper, non-metallised paper, plastic paper or laminate, wax paper, or combinations thereof. The inner wrapper material may be formed as a laminate of a metallised polyethylene film, and a liner material. The inner wrapper material may be a super-calendered glassine paper. In addition, the inner wrapper material may be provided with a print-receptive top coating. The inner wrapper preferably has an access opening through which the consumer goods can be removed when the lid portion is in the open position.

In any of the embodiments of the invention described above, the selection of consumer goods may comprise about 25 percent or less of the total number of consumer goods within the container. The selection of consumer goods may be less than about 4 consumer goods. The selection of consumer goods may be a single consumer good.

In any of the embodiments described above, the container may comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. Additionally, or alternatively, the outer wrapper may be printed with images, consumer information or other data.

The container is preferably a rectangular parallelepiped comprising two wider walls spaced apart by two narrower walls. Containers according to the invention may be in the shape of a rectangular parallelepiped, with right-angled longitudinal and right-angled transverse edges. Alternatively, the container may comprise one or more rounded longitudinal edges, rounded transverse edges, bevelled longitudinal edges or bevelled transverse edges, or combinations thereof.

Alternatively, the container may have a non-rectangular transversal cross section, for example polygonal such as triangular or hexagonal, semi-oval or semi-circular.

In any of the embodiments described above, the plurality of consumer goods may comprise a plurality of aerosol-generating articles. The consumer goods may comprise elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles.

The smoking articles may be arranged in different collations, depending on the total number of smoking articles.

Containers according to the present invention may hold smoking articles of the same type or brand, or of different types or brands. In addition, both filter-less smoking articles and smoking articles with various filter tips may be contained, as well as smoking articles of differing length (for example, between about 40 mm and about 180 mm), diameter (for example, between about 4 mm and about 9 mm). Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The height, width and depth of containers according to the invention may be such that the resultant overall dimensions of the container are similar to the dimensions of a typical pack of twenty cigarettes.

The exterior surfaces of containers according to the invention may be printed, embossed, debossed or otherwise embellished with manufacturer or brand logos, trade marks, slogans and other consumer information and indicia.

Containers according to the present invention may be formed from one or more folded laminar blanks. Preferably, the outer housing comprising the box portion, the lid portion and the hinged connector, is formed from a single folded laminar blank. The inner frame may be formed from the same laminar blank as the outer housing. Alternatively, the inner frame may be formed from a separate laminar blank. Laminar blanks may be formed from any suitable material or combination of materials, including, but not limited to, cardboard, paperboard, plastic, metal, or combinations thereof. Preferably, each laminar blank is a laminar cardboard blank having a weight of between about 100 grams per square meter and about 350 grams per square meter. In preferred embodiments, each laminar blank has a thickness of from about 100 micrometers to about 500 micrometers, preferably from about 150 micrometers to about 300 micrometers.

According to the present invention there is further provided a method for the manufacture of containers according to the invention, as defined above. The method comprises the steps of: providing a first laminar blank having a box-defining portion, a lid-defining portion and a hinged connector between the box-defining portion and the lid-defining portion, wherein the lid-defining portion depends along a first hinge line from the hinged connector; providing a second laminar blank comprising a frame-defining portion and one or more lift panels for defining a lifting element, wherein the one or more lift panels depend from the bottom edge of the frame-defining portion; wrapping the second laminar blank around a plurality of consumer goods such that the lifting element is positioned underneath a selection of the consumer goods; assembling the first laminar blank around the inner frame to form the box portion, lid portion and hinged connector of the outer housing; and connecting the lid portion to the inner frame such that the lid portion depends from the inner frame about a second hinge line.

The skilled person will appreciate that in order to produce a container according to the invention, the outer housing of the container is assembled around the inner frame such that the lifting element of the inner frame is positioned at the bottom of the container, underneath the selection of consumer goods to be lifted.

The invention will now be further described, by way of example only, with reference to the following drawings in which.

Figure 1:
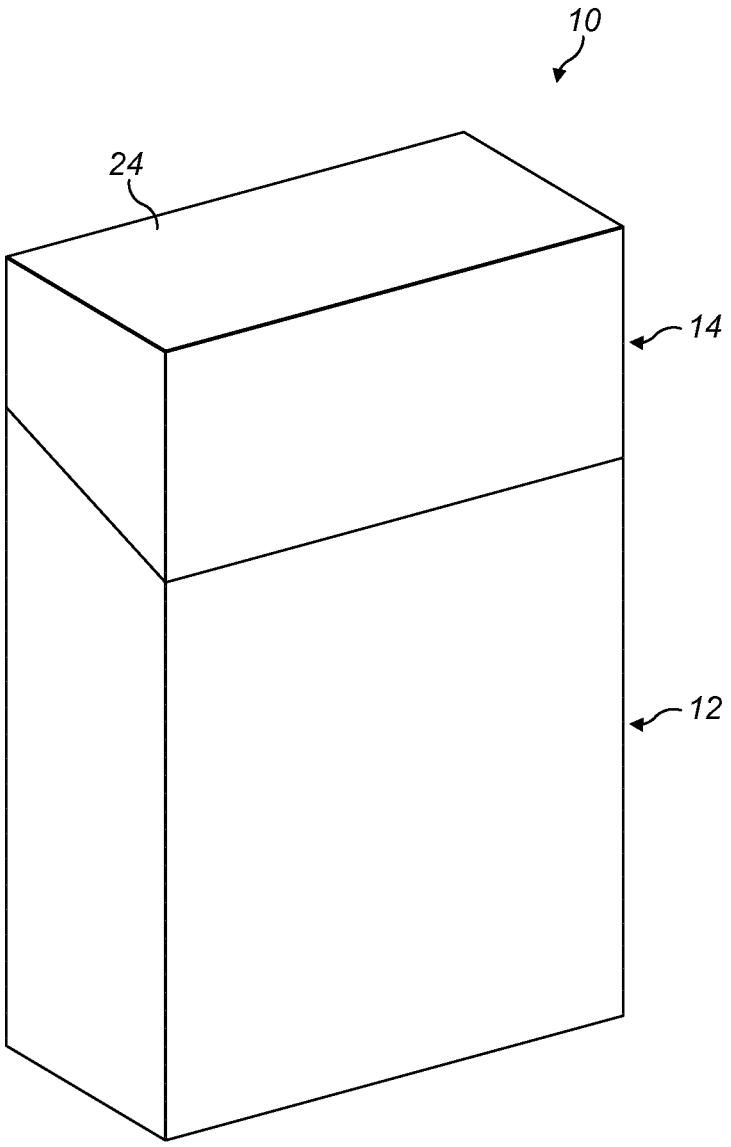
FIG. 1 shows a front perspective view of a container in accordance with an embodiment of the present invention, with the lid portion in the closed position.

FIGS. 1 to 4 show a container 10 in accordance with an embodiment of the present invention. The container 10 comprises a box portion 12, a lid portion 14 and a hinged connector 16 connecting the box portion 12 to the lid portion 14. An inner frame 18 is slidably received within the box portion 12 and a bundle of elongate smoking articles 20 is received within the inner frame 18. The bundle of smoking articles 20 is wrapped in an inner wrapper 22 positioned between the bundle of smoking articles 20 and the inner frame 18.

Figure 2:
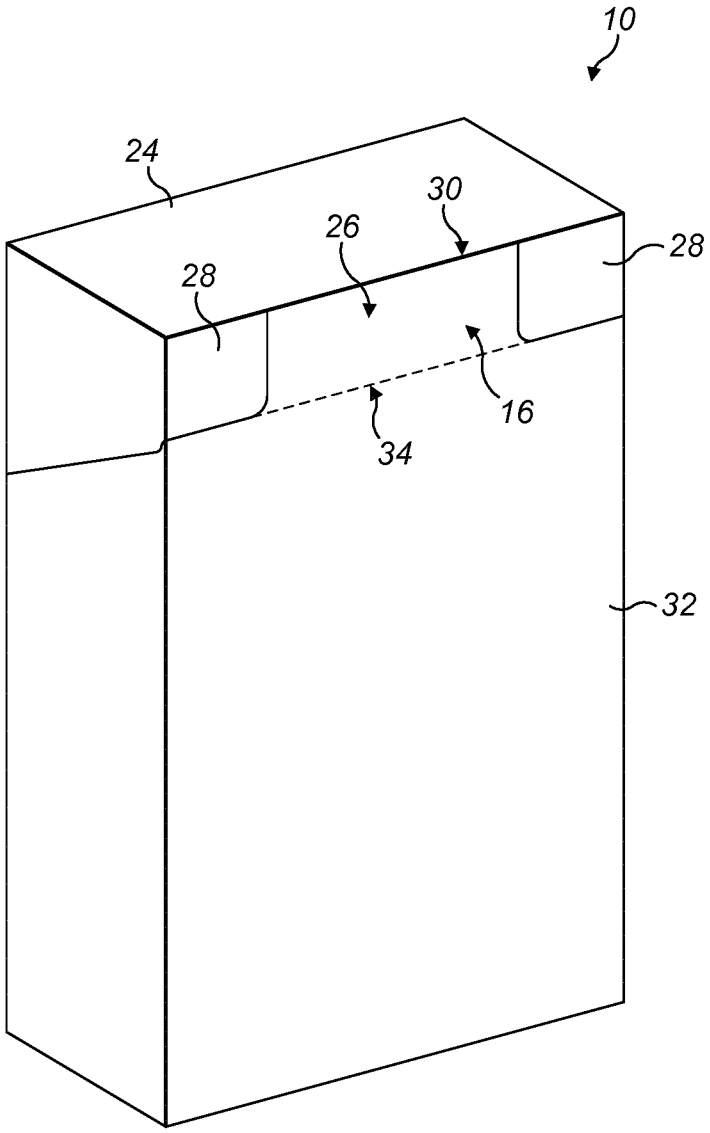
FIG. 2 shows a back perspective view of the container of FIG. 1, with the lid portion in the closed position.

The lid portion 14 comprises a lid front wall, opposed lid side walls, a lid top wall 24 and a lid back wall 26. As shown in FIG. 2, the lid back wall 26 is formed of three adjacent panels: an intermediate panel forming the hinged connector 16 and a pair of lid portion back panels 28 on either side of the intermediate panel. The three panels of the lid back wall 26 are defined by a pair of vertical cut lines extending between the top and bottom edges of the lid portion back wall 26. The hinged connector 16 is connected to the lid top wall 24 along a first hinge line 30 extending along the top edge of the lid back wall 26. The lid portion back panels 28 are each affixed to the inner frame 18, as described in more detail below.

Figure 3:
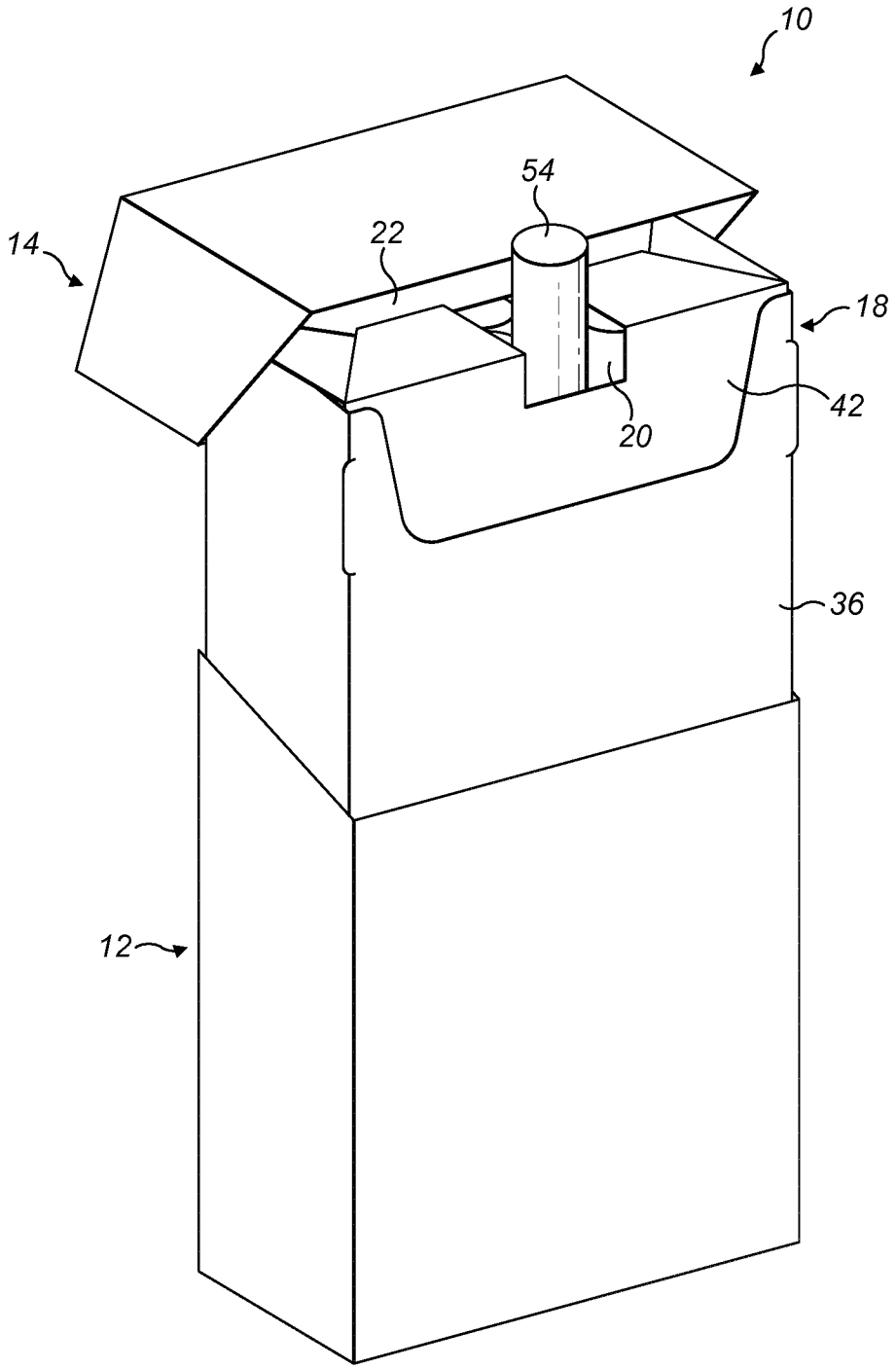
FIG. 3 shows a front perspective view of the container of FIGS. 1 and 2, with the lid portion in the open position and the inner frame in the raised position.
Figure 4:
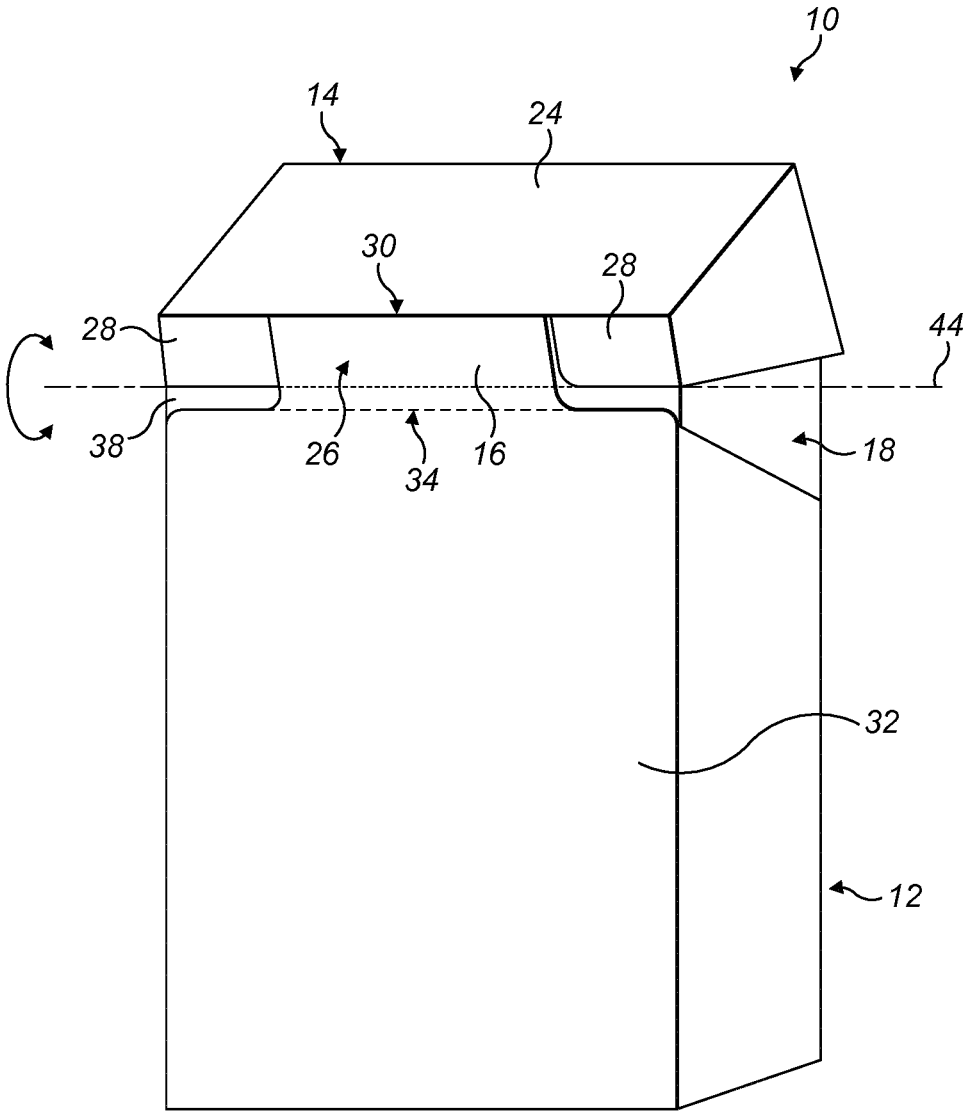
FIG. 4 shows a back perspective view of the container of FIGS. 1 to 3, with the lid in a slightly open position.

The lid portion 14 is pivotable between the closed position shown in FIGS. 1 and 2 and the fully open position shown in FIG. 3. In FIG. 4, the lid portion 14 is shown partially open.

The box portion 12 comprises a box front wall, opposed box side walls, a box bottom wall and a box back wall 32. The hinged connector 16 is connected to the box back wall 32 along a third hinge line 34 extending transversely across the back face of the container, in approximately the position of the hinge line of a conventional hinge lid container. The third hinge line 34 extends across the full width of the container 10 such that the lid portion back panels 28 are also connected to the box back wall 32 along the third hinge line 34.

Figure 5:
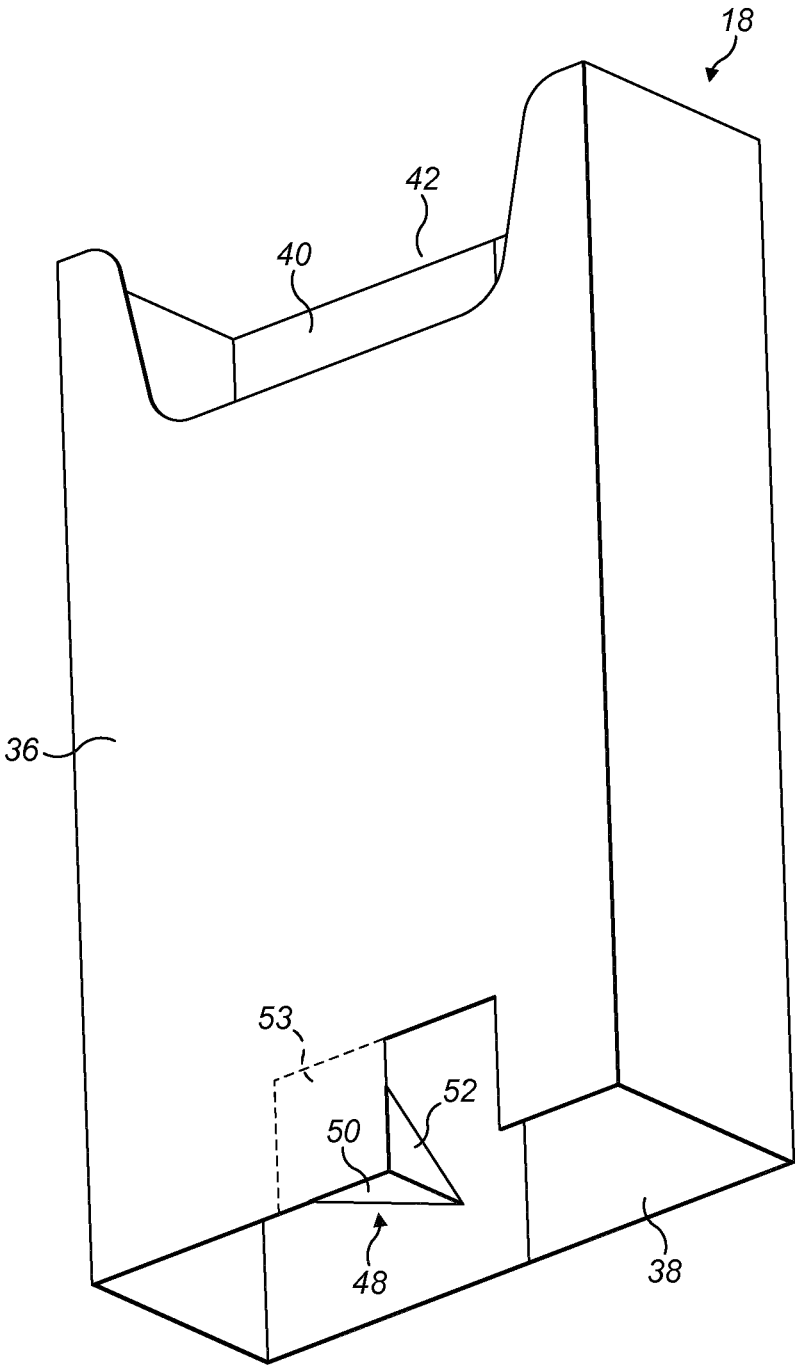
FIG. 5 shows a perspective view of the inner frame of the container of FIGS. 1 to 4.

As shown in FIG. 5, the inner frame 18 comprises a frame front wall 36, opposed frame side walls and a frame back wall 38 formed of two frame back wall panels 40. In the assembled container, the inner frame 18 surrounds the wrapped bundle of smoking articles 20 and the walls of the inner frame 18 underlie the corresponding walls of the box portion 12.

As shown in the figures, the top part of the inner frame 18 protrudes above the top edge of the box portion 12 and the frame front wall comprises a cut out 42 at the top, to facilitate removal of the smoking articles 20 from the container.

The inner frame back wall 38 comprises a second hinge line 44 extending transversely across the inner frame back wall 38 at a distance from the top edge. The second hinge line 44 defines an inner frame connector panel 46 at the top of each frame back wall panel 40. In the assembled container 10, the inner frame connector panels 46 are each affixed to the inner surface of a corresponding lid portion back wall panel 28 such that the lid portion 14 is pivotable about the second hinge line 44. The height of the inner frame connector panels 46 substantially corresponds to the height of the lid portion back wall panels 28 such that the inner frame connector panels 46 overlie the lid portion back wall panels 28.

The inner frame 18 is mounted within the box portion but is not affixed to the box portion 12 in any way and is therefore free to slide upwards and downwards within the box portion 12.

In the closed position of the lid portion 14, as shown in FIGS. 1 and 2, the container 10 has a rectangular parallelepipedal shape in which the walls of the lid portion 14 form substantially continuous extensions of the corresponding walls of the box portion 12. The closed container 10 has substantially the same appearance as a conventional hinge lid container without a hinged connector. In this position, the inner frame 18 is in the lowered position with the lifting element 48 at the bottom of the box portion 12, adjacent the box bottom wall.

As the lid portion 14 moves towards the open position shown in FIG. 3, the lid portion 14 pivots backwards relative to the hinged connector 16 about the first hinge line 30 and additionally pivots backwards relative to the inner frame 18 and the bundle of smoking articles 20 about the second hinge line 44. The hinged connector 16 pivots backwards relative to the box portion 12 about the third hinge line 34 such that the entire lid portion 14 moves backwards and away from the box portion 12. The connection between the lid portion 14 and the inner frame 18 means that as the lid portion 14 is moved towards the open position, the inner frame 18 is pulled upwards, away from the box bottom wall. FIG. 3 shows the container 10 with the lid portion 14 in an open position and the inner frame 18 in the raised position. In this position, the inner frame 18 is raised to the maximum extent out of the box portion 12. The inner frame 18 is prevented from further movement in an upwards direction since further movement of the lid portion 14 is restricted as a result of the connection of the lid portion 14 to the box portion 12.

As shown in FIG. 5, the inner frame 18 comprises a lifting element 48 which depends from the bottom edge of the frame front wall 36 and is formed as an integral part of the inner frame 18. The lifting element 48 comprises a triangular bottom lift panel 50 extending substantially horizontally from the bottom edge of the frame front wall 36 and a triangular side lift panel 52 extending substantially vertically upwards from the bottom lift panel 50. In the assembled container 10, the bottom lift panel 50 underlies a single smoking article 54 within the bundle and the side lift panel 52 extends upwards, alongside that single smoking article 54.

The inner wrapper 22 surrounding the smoking articles 20 includes an aperture (not shown) to allow the bottom lift panel 50 and the side lift panel 52 to directly contact the smoking article. As the inner frame 18 moves upwards towards the raised position shown in FIG. 3, the lifting element 48 pushes the smoking article 54 supported on the bottom lift panel 50 in an upwards direction such that it is raised upwards relative to the remaining smoking articles 20 in the bundle.

The bottom of the inner wrapper 22 is affixed to the inner surface of the box bottom wall, away from the position of the aperture, to ensure that the remainder of the bundle of smoking articles 20 remains at the bottom of the box portion 12 as the single smoking article 54 is raised.

Figure 6:
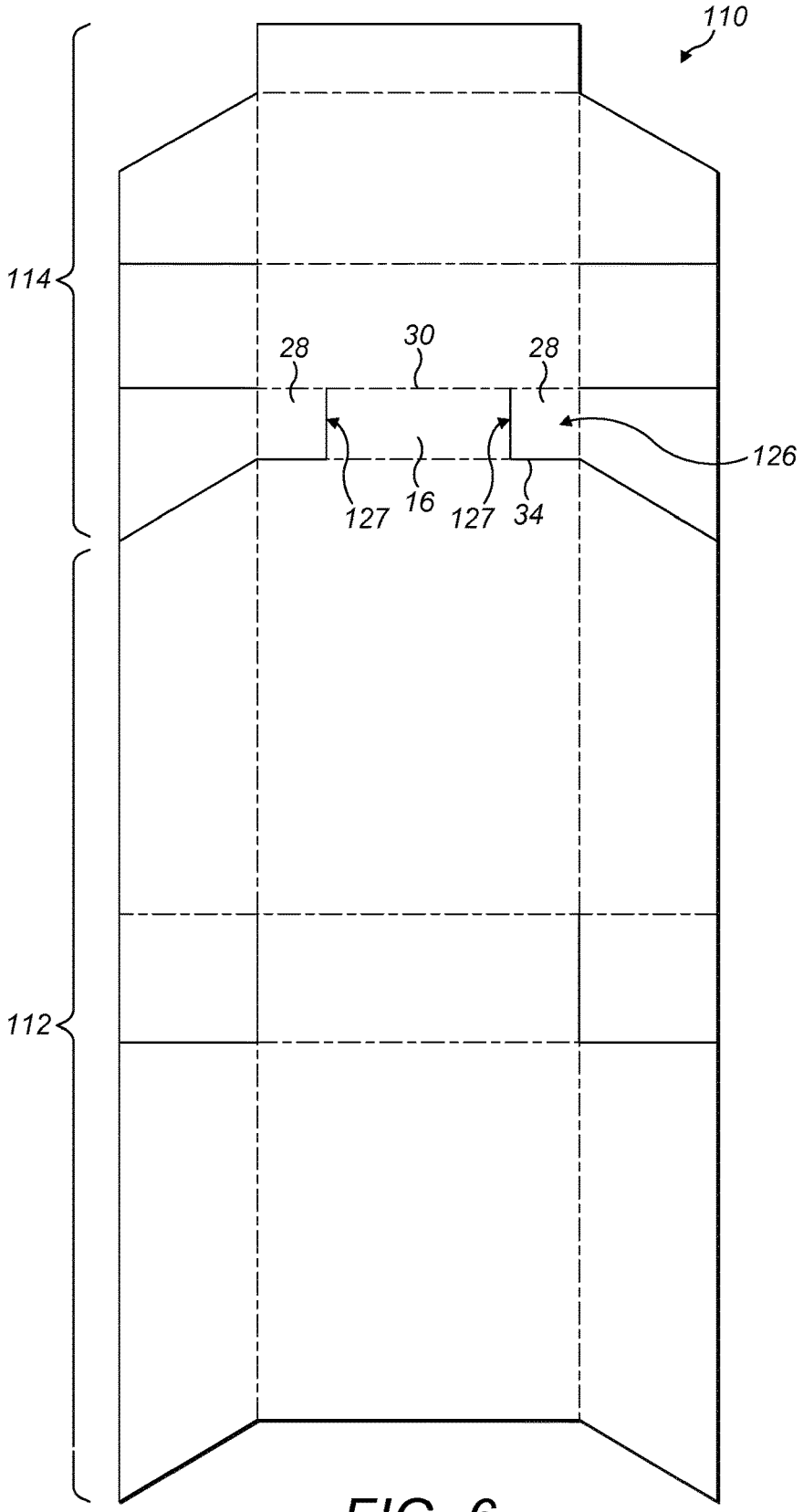
FIG. 6 shows a plan view of a laminar blank for forming the outer housing of the container of FIGS. 1 to 4.

FIG. 6 shows a single laminar blank 110 for forming the box portion 12, lid portion 14 and hinged connector 16 of the container 10. The laminar blank 110 comprises a box-defining portion 112 for forming the box portion 12, a lid-defining portion for forming the lid portion 14. The dashed lines are used to indicate fold lines whilst the solid lines indicate cut lines. As shown in FIG. 6, the lid back wall panel 126 comprises a pair of substantially vertical cut lines 127 extending between the first hinge line 30 and the third hinge line 34. These cut lines 127 define the hinged connector 16 in the centre of the lid back wall panel 126 and the lid portion back panels 28 on either side of the hinged connector 16.

Figure 7:
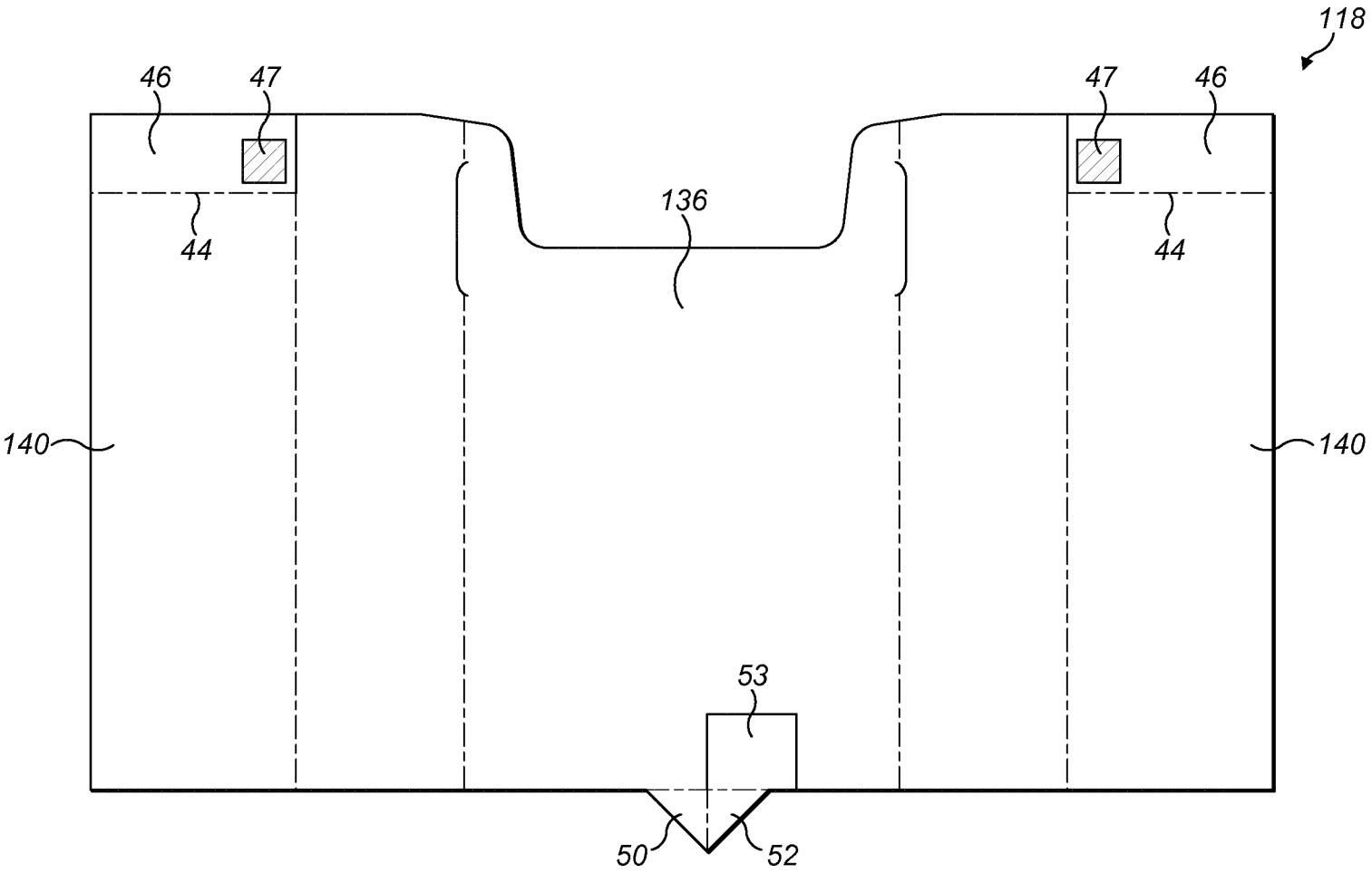
FIG. 7 shows a plan view of a laminar blank for forming the inner frame of the container of FIGS. 1 to 4.

FIG. 7 shows a single laminar blank 118 for forming the inner frame 18 of the container 10 including the lifting element 48. The laminar blank 118 comprises a frame front wall panel 136, opposed frame side wall panels and two frame back wall panels 140 at each side of the blank 118. A second hinge line 44 extends across each of the frame back wall panels 140 to define the inner frame connector panels 46 as described above. An area of adhesive 47 is provided on each inner frame connector panel 46 to affix it to the inner surface of the corresponding lid portion back panel 28 when the container 10 is assembled.

As shown in FIG. 7, the bottom 50 and side 52 lift panels for defining the lifting element 48 extend from the bottom edge of the frame front wall panel 136 and are connected to each other along a fold line 51. A tab 53 depending from the side lift panel 52 along the bottom edge of the frame front wall panel 136 is cut away from the remainder of the frame front wall panel 136. In order to form the three-dimensional lifting element 48, the tab 53 is separated from the remainder of the frame front wall panel 136, rotated anticlockwise by 90 degrees and adhered to the inner or outer surface of the frame front wall panel 136, in a position adjacent to the position in which the tab 53 was originally defined. This causes the side lift panel 52 to be folded upwards at 90 degrees to the bottom lift panel 50 about the fold line 51, as shown in FIG. 5.

In order to form the assembled container 10, the inner frame 18 is folded around the wrapped bundle of smoking articles 20 in the inner wrapper 22 with the lifting element 48 assembled as described above such that the bottom lift panel 50 lies beneath one of the smoking articles within the bundle. The laminar blank 110 is then folded around the inner frame 18 and the bundle of smoking articles 20 to form the box portion 12 and the lid portion 14. This may be done using conventional assembly techniques with the only required modification being to apply adhesive to the inner frame connector panels such that they are affixed to the inner surface of the corresponding lid portion back panels 28 upon assembly of the lid portion 14.

The invention claimed is:

1. A container for consumer goods, the container comprising:

an outer housing comprising a box portion, a lid portion moveable between a closed position and an open position, and a hinged connector connecting the box portion and the lid portion;

a plurality of consumer goods received within the box portion; and an inner frame slidably received within the outer housing and positioned between the plurality of consumer goods and the box portion, wherein the inner frame is slidable between a lowered position and a raised position, wherein the inner frame comprises an inner frame front wall, an inner frame back wall, opposed inner frame side walls and an opening at the bottom end, and wherein the inner frame further comprises a lifting element depending from the bottom edge of a wall of the inner frame and extending into the opening at the bottom end of the inner frame, at least part of the lifting element being positioned between a box portion bottom wall and the consumer goods such that sliding the inner frame from the lowered position towards the raised position engages the lifting element with a selection of the plurality of consumer goods and lifts the selection of consumer goods away from the box portion bottom wall, wherein the lid portion depends along a first hinge line from the hinged connector and along a second hinge line from the inner frame so that the inner frame slides between the lowered position and the raised position as the lid portion moves between the closed position and the open position.

2. The container according to claim 1 wherein the hinged connector depends along a third hinge line from the box portion.

3. The container according to claim 1 wherein the hinged connector forms at least a part of a lid portion back wall.

4. The container according to claim 3 wherein the lid portion comprises a lid portion top wall and a lid portion back wall and wherein the hinged connector is formed of an intermediate panel of the lid portion back wall, the intermediate panel depending along the first hinge line from the lid portion top wall and along the third hinge line from the box portion.

5. The container according to claim 1 wherein the lid portion comprises a first lid portion back panel depending along the second hinge line from the inner frame back wall and a second lid portion back panel depending along the second hinge line from the inner frame back wall and wherein the hinged connector extends between the first and second lid portion back panels.

6. The container according to claim 5 wherein the lid portion comprises a lid portion back wall and wherein the first lid portion back panel, the second lid portion back panel and the hinged connector are formed from a part of the lid portion back wall.

7. The container according to claim 5 wherein the inner frame further comprises an inner frame connector panel depending along the second hinge line from the inner frame back wall and wherein the inner frame connector panel is affixed to the inner surface of the first and second lid portion back panels.

8. The container according to claim 1 wherein the lifting element depends from a bottom edge of the inner frame front wall.

9. The container according to claim 8 wherein the lifting element comprises a bottom lift panel positioned between the box portion bottom wall and the consumer goods and at least one side lift panel extending from the bottom lift panel between consumer goods.

10. The container according to claim 1 wherein the lid portion has both a pivotal movement and a translational movement relative to the box portion as the lid portion moves between the closed position and the open position.

11. The container according to claim 1 further comprising an inner wrapper wrapped around the plurality of consumer goods, the inner wrapper comprising an aperture in a position corresponding to the lifting element of the inner frame such that the lifting element can contact the selection of consumer goods through the aperture.

12. The container according to claim 11 wherein the inner wrapper is affixed to the inner surface of the box portion bottom wall.

13. The container according to claim 1 wherein the outer housing is formed of a single laminar blank.

14. The container according to claim 1, wherein the plurality of consumer goods comprises a plurality of aerosol-generating articles.

15. A method for producing a container, the method comprising the steps of:

providing a first laminar blank having a box-defining portion, a lid-defining portion and a hinged connector between the box-defining portion and the lid-defining portion, wherein the lid-defining portion depends along a first hinge line from the hinged connector;

providing a second laminar blank comprising a frame-defining portion and one or more lift panels for defining a lifting element, wherein the frame-defining portion comprises a frame front wall panel, a frame back wall panel, a first frame side wall panel and a second frame side wall panel, and wherein the one or more lift panels depend from the bottom edge of a wall panel of the frame-defining portion;

wrapping the second laminar blank around a plurality of consumer goods such that the lifting element is positioned underneath a selection of the consumer goods;

assembling the first laminar blank around the inner frame to form the box portion, lid portion and hinged connector of the outer housing; and connecting the lid portion to the inner frame such that the lid portion depends from the inner frame about a second hinge line.

* * * * *